US010575641B1

(12) United States Patent
Severa

(10) Patent No.: US 10,575,641 B1
(45) Date of Patent: Mar. 3, 2020

(54) SHELVING SYSTEM, SHELF UNIT, AND METHOD OF ASSEMBLING SHELF UNIT

(71) Applicant: REHAU Industries LLC, Leesburg, VA (US)

(72) Inventor: Michael W. Severa, Winchester, VA (US)

(73) Assignee: REHAU INDUSTRIES, L.L.C., Leesburg, VA (US)

( * ) Notice: Subject to any disclaimer, the term of this patent is extended or adjusted under 35 U.S.C. 154(b) by 0 days.

(21) Appl. No.: 15/999,027

(22) Filed: Aug. 20, 2018

(51) Int. Cl.
*A47B 96/02* (2006.01)
*A47B 96/06* (2006.01)

(52) U.S. Cl.
CPC ..... *A47B 96/066* (2013.01); *A47B 96/028* (2013.01); *A47B 96/061* (2013.01)

(58) Field of Classification Search
CPC .... A47B 96/066; A47B 96/026; A47B 96/061
See application file for complete search history.

(56) References Cited

U.S. PATENT DOCUMENTS 3,048,279 A * 8/1962 Mann ..... A47B 57/04 108/152
3,333,555 A * 8/1967 Kapnek ..... A47B 96/066 108/108
3,363,867 A * 1/1968 Zackrisson ..... A47B 57/18 108/152
3,527,175 A * 9/1970 Kapnek ..... A47B 5/02 108/152
3,704,675 A 11/1972 Bellasalma
3,754,518 A * 8/1973 Wachtel ..... A47B 5/02 108/152
3,807,102 A 4/1974 Albinson et al.
4,036,559 A * 7/1977 Whitchurch ..... F16B 12/14 403/361
4,381,715 A * 5/1983 Forman ..... A47B 96/066 108/102
4,720,069 A 1/1988 Bessinger
(Continued)

FOREIGN PATENT DOCUMENTS

CA 2328650 A1 * 6/2002 ..... A47B 96/028
DE 2258412 A1 * 5/1974 ..... A47B 96/066
(Continued)

OTHER PUBLICATIONS

Outstanding Hidden Shelf Brackets for Wall Decoration Ideas, http://www.nrccamel.com/outstanding-hidden-shelf-brackets-for-wall-decoration-ideas/, Jul. 25, 2017, 10 pages.
(Continued)

*Primary Examiner* — Stanton L Krycinski
(74) *Attorney, Agent, or Firm* — Fitch, Even, Tabin & Flannery, L.L.P.

(57) ABSTRACT

A cavity formed in a shelf can receive at least one bracket including at least one locking member. A locking member can engage an interior of the cavity. A shelf unit can be assembled by fastening a bracket to a substrate, inserting the bracket into an opening to the cavity, engaging the locking member with an interior surface of the cavity, and allowing the shelf to rest on the body of the bracket. The shelf can be removed from the bracket by disengaging the locking member from the interior of the cavity.

21 Claims, 19 Drawing Sheets

(56) References Cited

U.S. PATENT DOCUMENTS

| | | | | | |
|---|---|---|---|---|---|
| 4,793,267 | A * | 12/1988 | Birillo | A47B 5/00 | 108/108 |
| 4,871,136 | A | 10/1989 | Bessinger et al. | | |
| 5,048,698 | A | 9/1991 | Konrad | | |
| 5,058,845 | A * | 10/1991 | Itagaki | A47B 96/066 | 248/346.04 |
| 5,197,703 | A * | 3/1993 | Pratolongo | A47B 57/04 | 108/152 |
| 5,326,061 | A * | 7/1994 | Hamilton | A47B 96/066 | 248/235 |
| 5,456,435 | A | 10/1995 | Sweeney | | |
| 5,799,803 | A * | 9/1998 | Muller | A47F 5/0043 | 108/108 |
| 6,164,610 | A * | 12/2000 | Santiago | A47B 96/022 | 211/90.01 |
| 6,520,704 | B1 * | 2/2003 | Vidmar | F16B 21/084 | 248/250 |
| 8,082,859 | B2 * | 12/2011 | Sevack | A47B 96/066 | 108/152 |
| 9,163,415 | B2 * | 10/2015 | Nies | A47B 96/061 | |
| 9,185,979 | B1 | 11/2015 | Jenks et al. | | |
| 9,538,859 | B1 | 1/2017 | Johnson et al. | | |
| 9,774,134 | B2 | 9/2017 | Bonner et al. | | |
| 9,775,450 | B2 | 10/2017 | Will et al. | | |
| 9,861,198 | B2 * | 1/2018 | Anderson | A47B 96/066 | |
| 10,463,151 | B2 * | 11/2019 | Murphy | A47B 96/1466 | |
| 2008/0224004 | A1 * | 9/2008 | Gallien | A47B 96/022 | 248/220.1 |
| 2009/0224119 | A1 * | 9/2009 | Heffernan | A47B 96/066 | 248/225.11 |
| 2016/0220023 | A1 | 8/2016 | Murphy | | |
| 2017/0074307 | A1 | 3/2017 | Slagle | | |
| 2017/0112281 | A1 | 4/2017 | Malott et al. | | |
| 2017/0143121 | A1 | 5/2017 | Grice et al. | | |
| 2017/0202372 | A1 | 7/2017 | Ringel | | |
| 2017/0215586 | A1 | 8/2017 | Zonneveld | | |

FOREIGN PATENT DOCUMENTS

| | | | | | |
|---|---|---|---|---|---|
| DE | 2425754 | A1 * | 12/1975 | A47B 96/066 | |
| DE | 4403927 | A1 * | 8/1994 | A47B 96/066 | |
| DE | 9415627 | U1 * | 11/1994 | A47F 3/001 | |
| DE | 29513690 | U1 * | 10/1995 | A47B 96/061 | |
| DE | 29608455 | U1 * | 8/1996 | A47B 96/061 | |
| DE | 19507483 | A1 * | 9/1996 | A47B 96/066 | |
| DE | 19618515 | A1 * | 11/1997 | A47B 96/061 | |
| DE | 102011112029 | A1 * | 3/2013 | F16B 12/125 | |
| EP | 1844682 | A2 * | 10/2007 | A47B 57/045 | |
| FR | 2663998 | A1 * | 1/1992 | A47B 96/066 | |
| FR | 2664142 | A3 * | 1/1992 | A47B 96/066 | |
| FR | 2711046 | A1 * | 4/1995 | A47B 57/46 | |
| GB | 2003724 | A * | 3/1979 | A47B 96/066 | |
| GB | 2082895 | A * | 3/1982 | A47B 96/066 | |
| GB | 2109672 | A * | 6/1983 | A47B 96/022 | |
| WO | WO-2010083916 | A1 * | 7/2010 | A47B 96/066 | |
| WO | WO-2014111261 | A1 * | 7/2014 | A47B 96/07 | |
| WO | 2016/138561 | A1 | 9/2016 | | |
| WO | WO-2018028842 | A1 * | 2/2018 | A47B 96/066 | |

OTHER PUBLICATIONS

HDD Pictures of Floating Shelves for Attractive Room Design, http://www.shaadiinvite.com/floating-shelves-for-attractive-room-design/floating-shelves-you-can-look-modern-floating-shelves-you-can-look-narrow-shelf-you-can-look-whereto-buy-floating-shelves/, Jan. 1, 2018, 4 pages.

Floating Self Bracket, Google image search, 1 page, retrieved May 8, 2018.

DIY Floating Shelf Brackets, http://www.theshindigclayton.com/install-floating-shelf-brackets/diy-floating-shelf-brackets/, 5 pages, retrieved May 8, 2018.

English language machine translation of DE 10 2011 112 029 A1 to Kern.

* cited by examiner

SHELVING SYSTEM, SHELF UNIT, AND METHOD OF ASSEMBLING SHELF UNIT

FIELD

The disclosure pertains to shelving, shelving systems, shelf units, and methods of assembling the same.

BACKGROUND

Shelving can take many forms, including free-standing shelving, built-in shelving, cabinet shelving, etc. A floating shelf is a special type of shelf that typically comprises a shelf and an internal bracket system including brackets or an assembly of brackets supporting the shelf. The bracket system is generally attached to a wall and hidden within the shelf. Floating shelves are named for the shelf appearing to float against the wall without support.

When installing a floating shelf on a wall reinforced by studs, the bracket system can be anchored to the studs to ensure the shelf has sufficient weight bearing capacity. However, studs can be positioned in portions of a wall that are undesirable for mounting the bracket system. Therefore, an installer must decide between anchoring the bracket system to studs or some other aesthetically desirable location without stud reinforcement. Also, the spacing between studs may differ from the spacing between fastening points of a bracket assembly, preventing multiple fastening points of the system from being anchored to separate studs. This type of installation can promote failure of the shelf, especially under heavy loads.

In some floating shelves, a fastener passes through an external surface of the shelf and contacts the bracket system to prevent movement of the shelf relative to the bracket. The fastener can be hidden on the bottom surface of the shelf but may remain undesirably visible from below. Also, if one of the major surfaces of a shelf becomes damaged or blemished, it may be impossible to flip the shelf to hide such a defect from view, due to the required positioning of the fastener relative to the bracket system. It may also be undesirable to flip a shelf and expose the head of the fastener from above. The fastener also poses difficulty when removing a shelf from a bracket system because the fastener must first be removed or loosened. Also, a fastener can undesirably loosen over time and pose a risk that the shelf is not securely fastened to a wall. While a bracket of a floating shelf can be glued within the shelf, this configuration poses problems of difficult removal of the shelf.

SUMMARY

The present application generally relates to a shelving system, a shelving unit, and a method of assembling a shelf unit. A cavity formed in a shelf can receive at least one bracket including at least one locking member. A locking member can engage an interior of the cavity. A shelf unit can be assembled by fastening a bracket to a substrate, inserting the bracket into an opening to the cavity, engaging the locking member with an interior surface of the cavity, and allowing the shelf to rest on the body of the bracket. A connection can be established between a bracket and a shelf without requiring any additional fasteners or tools. The shelf can be easily removed from the bracket without any tools by simply disengaging the locking member from the interior of the cavity.

BRIEF DESCRIPTION OF THE DRAWINGS

FIG. 1R illustrates the bracket and shelf of FIGS. 16 and 17, with the bracket fully inserted into the shelf.

DETAILED DESCRIPTION

Figure 1:
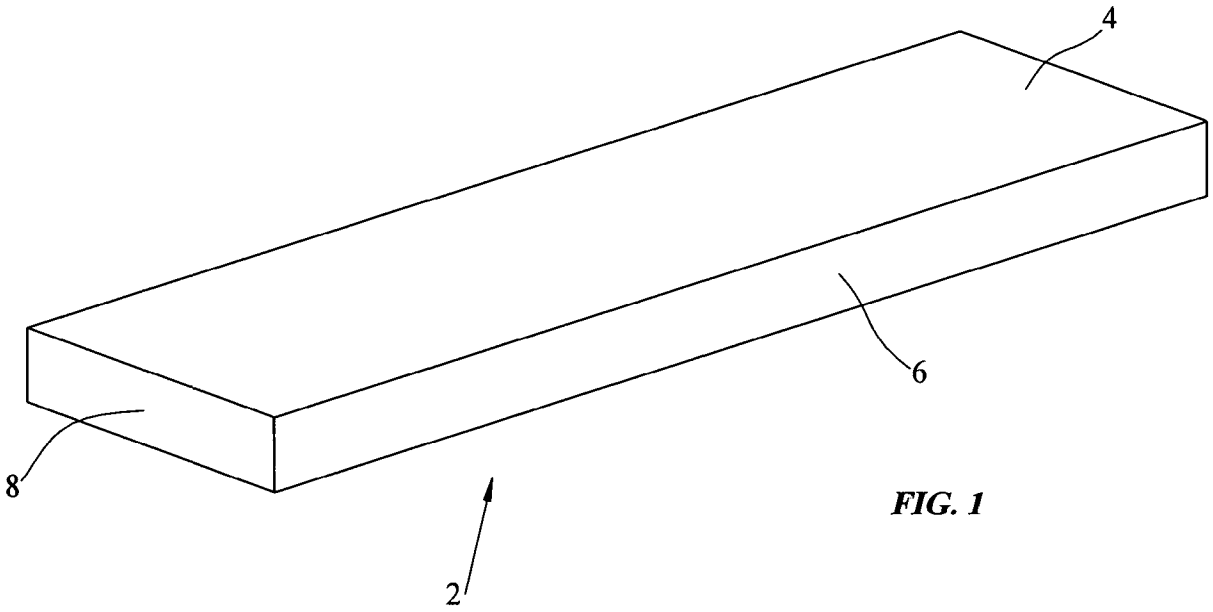
FIG. 1 illustrates a front perspective view of an embodiment of a shelf unit.

In various nonexclusive embodiments, the present application provides a shelving system, a shelving unit, and a method of assembling a shelf unit. It has been discovered that problems associated with floating shelving can be addressed by generally providing a shelf including a cavity and at least one bracket including at least one locking member. The bracket can fit within the cavity and the locking member can engage an interior of the cavity. This configuration can provide a connection between the bracket and the shelf without requiring any additional fasteners or tools. Also, this configuration allows easy removal of the shelf from the bracket without any tools by simply disengaging the locking member from the interior of the cavity.

A shelf can generally include any number of surfaces such as top, bottom, rear, front, and side surfaces. In some aspects, a rear surface of a shelf includes an opening to a cavity for receiving at least one bracket, so that the bracket can be hidden within the shelf. A cavity can generally have any number of surfaces, such as upper, lower, front, and side surfaces. An upper surface of a cavity can rest on an upper surface of a body of the bracket by the force of gravity when the bracket is attached to a substrate and inserted into the cavity. A cavity can generally have any depth. In some aspects, a cavity has a depth that is sufficient to fully receive a bracket and a locking member so as to hide the bracket and locking member from view when a shelf is installed on a substrate. Some embodiments of a shelf comprise a cavity having a depth of at least half of, or substantially an entire depth from a rear surface to a front surface of a shelf. In some embodiments, a bracket with a locking member extends through at least half of, or substantially an entire depth of the cavity.

A shelving system or shelf unit can generally comprise any number of brackets, e.g. 1, 2, 3, 4, 5, etc., to support a shelf. A bracket can comprise a body extending in a longitudinal direction from a first end to a second end. A first end of a bracket can be attached to any substrate, e.g. a wall, post, board, cabinet back, frame, etc. Exemplary load-bearing and non-load-bearing walls include shear walls including wood, metal, polymeric, or composite studs sheared with drywall, cement board, paneling, plywood, etc.; precast or poured concrete walls; masonry walls such as brick walls, stone walls, etc.; panel walls; partition walls; cavity walls; veneered walls; faced walls; etc. or any combination thereof.

In some aspects, a first end of a bracket can comprise a structure, e.g. a plate, a flange, etc. In some aspects, a fastener can be passed through the structure at the first end of the bracket and into a substrate to directly fasten the bracket to the substrate. A cavity can have a depth that is sufficient to fully receive a bracket and a locking member so as to hide the bracket and locking member from view when a shelf is installed on a substrate. In some embodiments, bracket including a locking member extends through at least half of, or substantially an entire depth of the cavity.

In other aspects, a shelving system or shelf unit can further comprise at least one mount that can serve as a base positioned between the substrate and a first end of a bracket. A fastener can pass through both a structure, e.g. a plate, a flange, etc., at the first end of the bracket and the mount to anchor the bracket and mount to the substrate. In other aspects, a mount can be connected to a substrate using a first fastener and the bracket can be attached the mount using a second fastener separate from the first fastener. A cavity can have a depth that is sufficient to fully receive a mount, a bracket, and a locking member so as to hide the mount, bracket, and locking member from view when a shelf is installed on a substrate. In some embodiments, a mount, bracket, and locking member extend through at least half of, or substantially an entire depth of the cavity.

A bracket can be attached to a one or both of a mount and a substrate using any type of fastener. Similarly, a mount can be attached to a substrate using any type of fastener. Exemplary fasteners include nails, screws, bolts, adhesives, manufactured interconnects between the mount and bracket, etc.

A bracket generally includes at least one locking member for engaging an interior surface of a cavity of a shelf. A locking member can extend from an upper surface of a body of a bracket. An upper surface of a bracket can generally oppose an upper surface of a cavity when the bracket is inserted in the cavity. A locking member can be positioned at any point on a body of a bracket, e.g. at a second end of a bracket or at any intermediate position between first and second ends of a bracket. In some aspects, a second end of the bracket can comprise a locking member extending from the body at an angle to the longitudinal direction of the body. A locking member can extend from an upper surface of a body of the bracket at any angle, e.g. orthogonal to the longitudinal direction of the body or any angle between orthogonal and parallel to the longitudinal direction of the body. A locking member can prevent relative motion between a bracket and a shelf when the bracket is inserted into a cavity of the shelf and the upper surface of the cavity rests on the body of the bracket by the force of gravity. These features can prevent a shelf from unintentionally sliding off a bracket. A locking member can comprise any structure that can engage an interior of a cavity. Exemplary locking members can include a tab, a post, a tongue, a lip, a spike, a claw, etc.

A cavity can generally include a height, measured in a direction from a bottom surface toward a top surface of a shelf, that is greater than a height of a bracket including at least one locking member. This configuration provides a clearance between a surface of a cavity and the bracket including at least one locking member. The clearance allows the shelf to be easily installed on a bracket. The clearance also allows the shelf to be removed from the bracket by lifting the shelf from a resting position on the bracket and pulling the shelf off the bracket.

A height of a bracket can generally be measured in a direction perpendicular to the longitudinal direction of the body of the bracket. A width of the bracket can be measured in a direction perpendicular to both the longitudinal direction and the height of the bracket. A width of the bracket can also be measured in a direction from one side surface of a shelf to an opposite side surface of the shelf when the bracket is inserted in a cavity of the shelf.

In some aspects, an interior of a cavity of a shelf can comprise one or more structures for engagement with a locking member. A structure for engagement with a locking member can be formed or positioned on one or more surfaces of an interior cavity. A structure for engagement with a locking member can be configured to have any shape or dimension for engagement with a single or multiple locking members. Exemplary structures for engaging a locking member include a groove, a notch, a ridge, etc. A structure for engagement with a locking member can be located at a position on an interior surface of a cavity of a shelf that coincides with a position of a locking member when a bracket is inserted in the cavity. In some embodiments, a structure for engagement with a locking member extends across an entire or substantially the entire width of a cavity between opposite side surfaces of a shelf. In other embodiments, the structure for engagement with a locking member has dimensions sufficient to contact one or more locking members and extends across only part of a width of a cavity, i.e. not across the entire or substantially the entire width of the cavity.

Embodiments of a shelf include an upper structure for engagement with a locking member. The upper structure can be formed on an upper surface of an interior of a cavity and extend across part of, or the entire width of the cavity measured between opposite side surfaces of a shelf. A bracket can be inserted into the cavity, the upper surface can be allowed to rest on a body of the bracket by the force of gravity, and a locking member can engage an upper structure. A clearance between a lower surface of the bracket and a lower surface of the cavity allows the shelf to be lifted so that the upper surface of the cavity disengages the body of the bracket and the upper structure disengages the locking member. The shelf can then be removed from the bracket.

Some embodiments of a shelf include upper and lower structures for engagement with a locking member formed on opposing interior surfaces of a cavity. The upper and lower structures can be spaced the same distance from the opening of the cavity and extend across part of, or the entire width of the cavity. A bracket can be inserted into a cavity of a shelf; an upper surface of the cavity can be allowed to rest on a body of the bracket by the force of gravity, and a locking member can engage the upper structure formed on the upper surface. A clearance between the lower surface of the bracket and the lower surface of the cavity allows the shelf to be lifted so that the upper surface of the cavity disengages the body of the bracket and the upper structure disengages the locking member. The shelf can then be removed from the bracket, flipped, and the bracket can be inserted into the cavity with the shelf in the opposite orientation (top surface of the shelf facing downward) so that the lower surface (ipso facto upper surface) of the cavity rests on the body of the bracket and the locking member engages the lower structure (ipso facto upper structure) for engagement with a locking member.

In some embodiments, an interior of a cavity can include interior surfaces comprising no structure specifically manufactured for engagement with a locking member, i.e. plain surfaces. Such plain surfaces may be milled, molded, smooth, rough, etc. A locking member comprising a structure such as spike or claw can bite into such a plain surface. A bracket can be inserted into the cavity, an upper surface of the cavity can rest on a body of the bracket by the force of gravity, and the locking member bite into the upper surface. A clearance between the lower surface of the bracket and the lower surface of the cavity allows the shelf to be lifted so that the locking member disengages the upper surface of the cavity. The shelf can also be flipped and the bracket inserted into the cavity with the shelf in the opposite orientation (top surface of the shelf facing downward) so that the lower plain surface (ipso facto upper plain surface) of the cavity rests on the body and the locking member bites into the lower plain surface (ipso facto upper plain surface) of the cavity.

Embodiments allowing a locking member to engage a shelf and allowing the shelf to be flipped and engaged with the locking member provide an advantage that the shelf can be placed on a bracket in either orientation without requiring any external fastener to secure the shelf to the bracket. These features also alleviate any concern for the need to hide such a fastener or hole for the fastener. Also, if a top or bottom surface of a shelf has a defect, the shelf can be flipped to hide the defect from view.

Embodiments of a shelf comprising a cavity including a plain upper surface or an upper surface comprising an upper structure for engagement a locking member that extends across substantially the entire width or the entire width of the cavity provide the following advantages. One or more brackets can be mounted at any position on a substrate behind the shelf or at any position on a mount, because the locking members can engage the interior of the cavity at any position. These embodiments also provide an advantage that brackets can be attached to studs or a mount and the position of the shelf can adjusted independent of the location brackets. Also, the number of brackets to be placed in the cavity can be selected and distributed depending on a load to be applied to the shelf. These advantages are compounded with other advantages discussed in this specification, when the cavity also includes a plain lower surface or a lower surface comprising a lower structure for engaging a locking member that mirrors the upper structure.

A method of assembling a shelf unit can include fastening at least one bracket to a substrate, e.g. a wall. A first end of a bracket can be fastened directly to a substrate or to a mount. In some aspects employing a mount, a first end of the bracket can be fastened to the mount and then the mount and bracket can be attached to the substrate; the mount can be attached to the substrate and then the first end of the bracket can be attached to the mount; or the mount and bracket can be simultaneously fastened to a substrate. In some aspects, a bracket can be inserted into an opening to a cavity on a rear surface of a shelf, a locking member on the bracket can engage an upper surface of the cavity, and the upper surface of the cavity can rest on the body of the bracket.

Generally, one or both of a shelf and a bracket can be constructed of any materials suitable for shelving. Exemplary materials include wood, particle board, fiber board, polymeric materials, metal, composite materials, etc. One or both of a shelf and a bracket can generally be manufactured using any suitable process. Exemplary processes include any one or more of milling, sawing, laminating, molding, machining, extruding, forging, stamping, welding 3D printing, etc.

Figure 2:
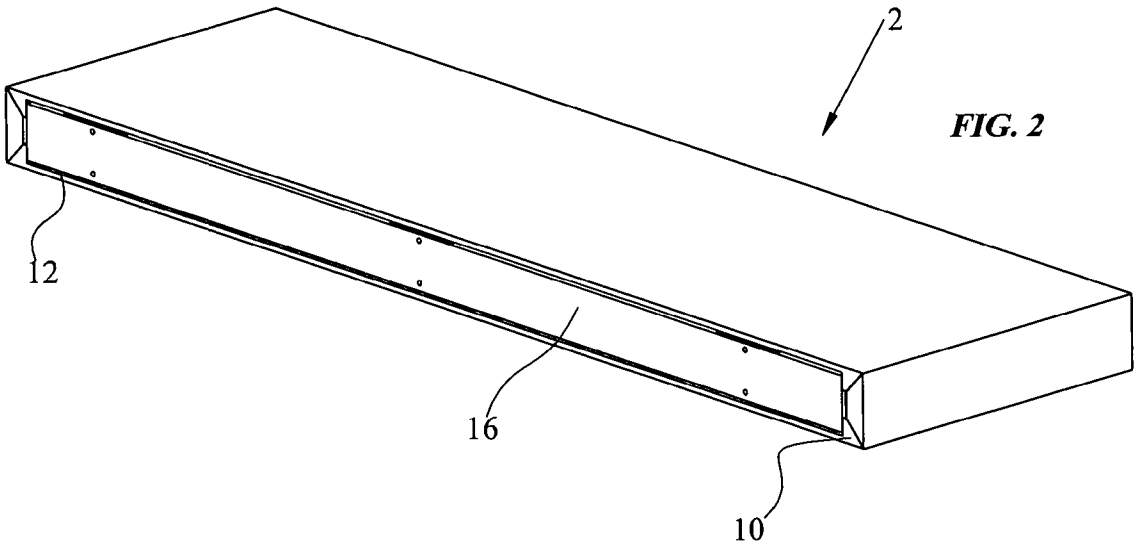
FIG. 2 illustrates a rear perspective view of the shelf unit of FIG. 1.

FIG. 1 illustrates an embodiment of a shelf 2 including a top surface 4, a front surface 6, and a side surface 8. FIG. 2 illustrates a rear surface 10 of the shelf 2. The rear surface includes an opening 12 to a cavity. In some aspects, a shelf unit or shelving system can comprise a mount 16 for attaching a bracket to a substrate such as a wall. FIG. 2 illustrates an embodiment of a mount 16 within the cavity of the shelf 2.

Figure 3:
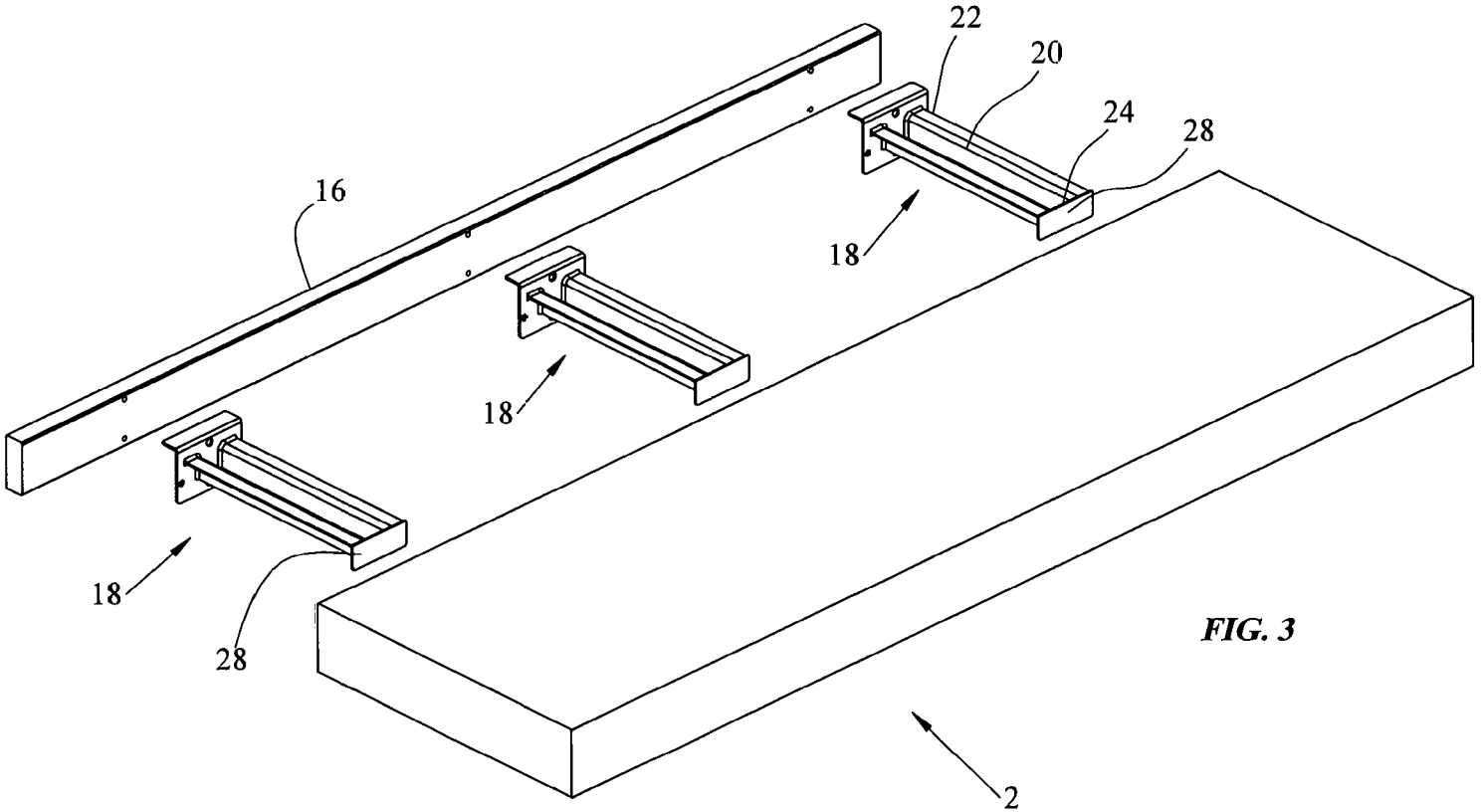
FIG. 3 illustrates a front perspective view of parts of an embodiment of a shelving system.
Figure 4:
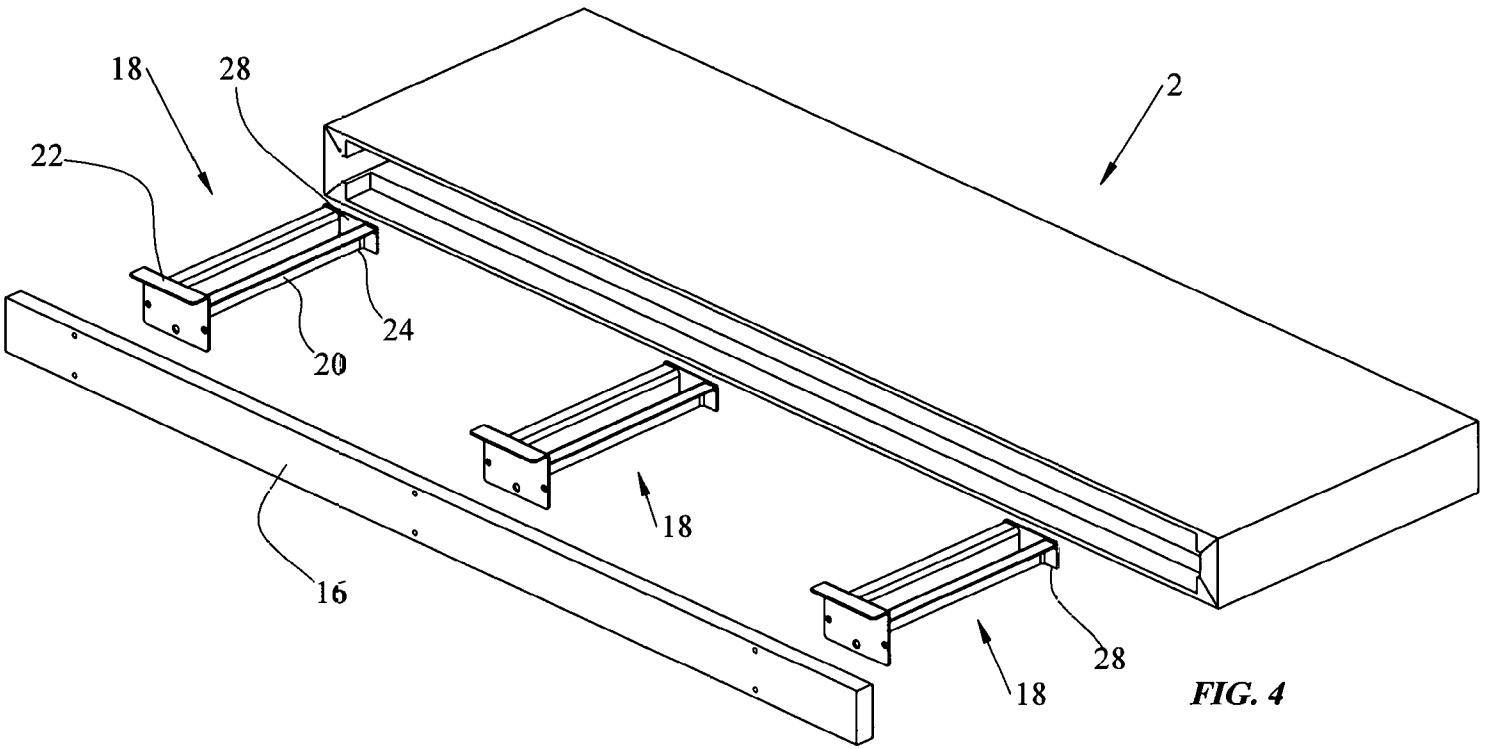
FIG. 4 illustrates a rear perspective view of the shelving system of FIG. 3.
Figure 5:
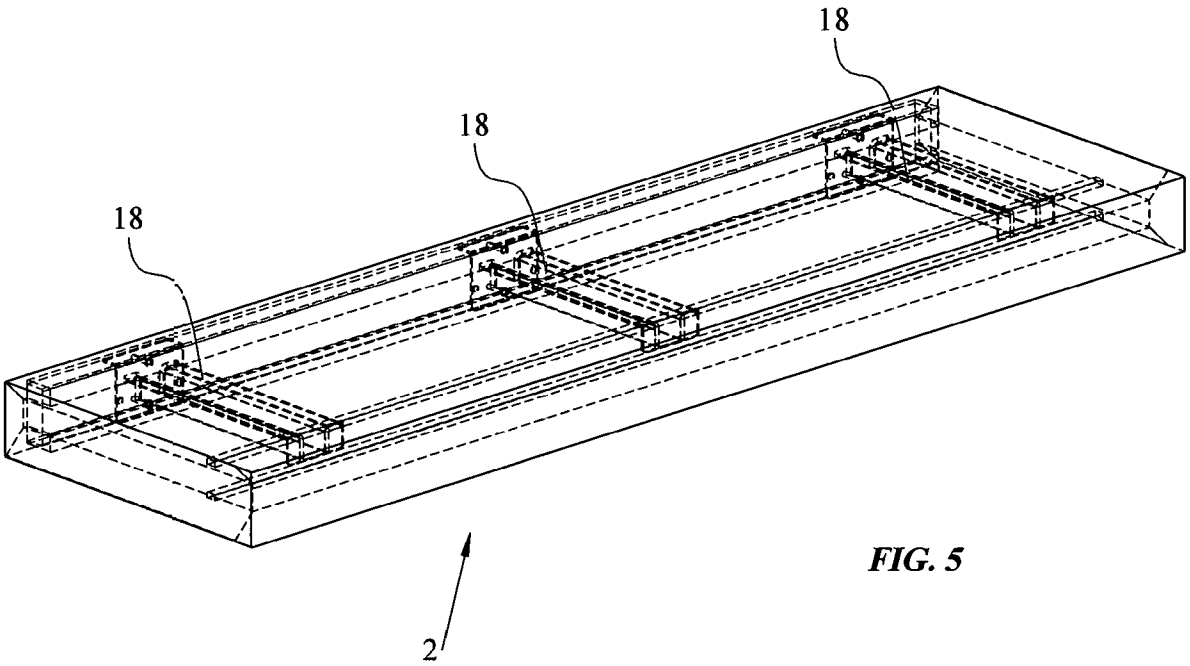
FIG. 5 illustrates a front transparent perspective view of an embodiment of a shelf unit assembled from the shelving system of FIGS. 3 and 4.
Figure 6:
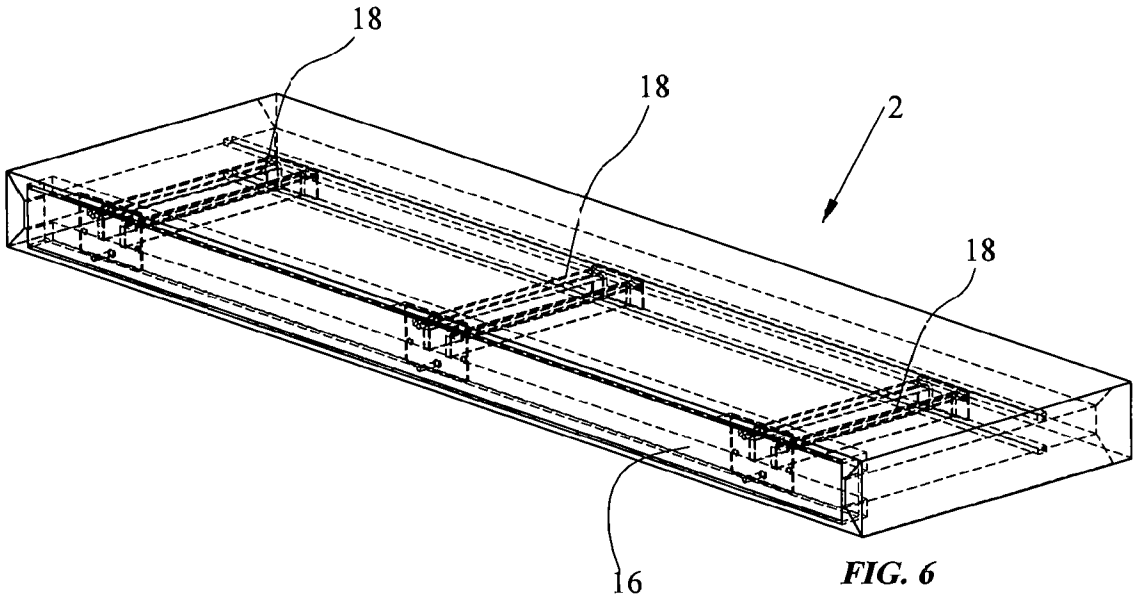
FIG. 6 illustrates a rear transparent perspective view of the shelf unit of FIG. 5.
Figure 7:
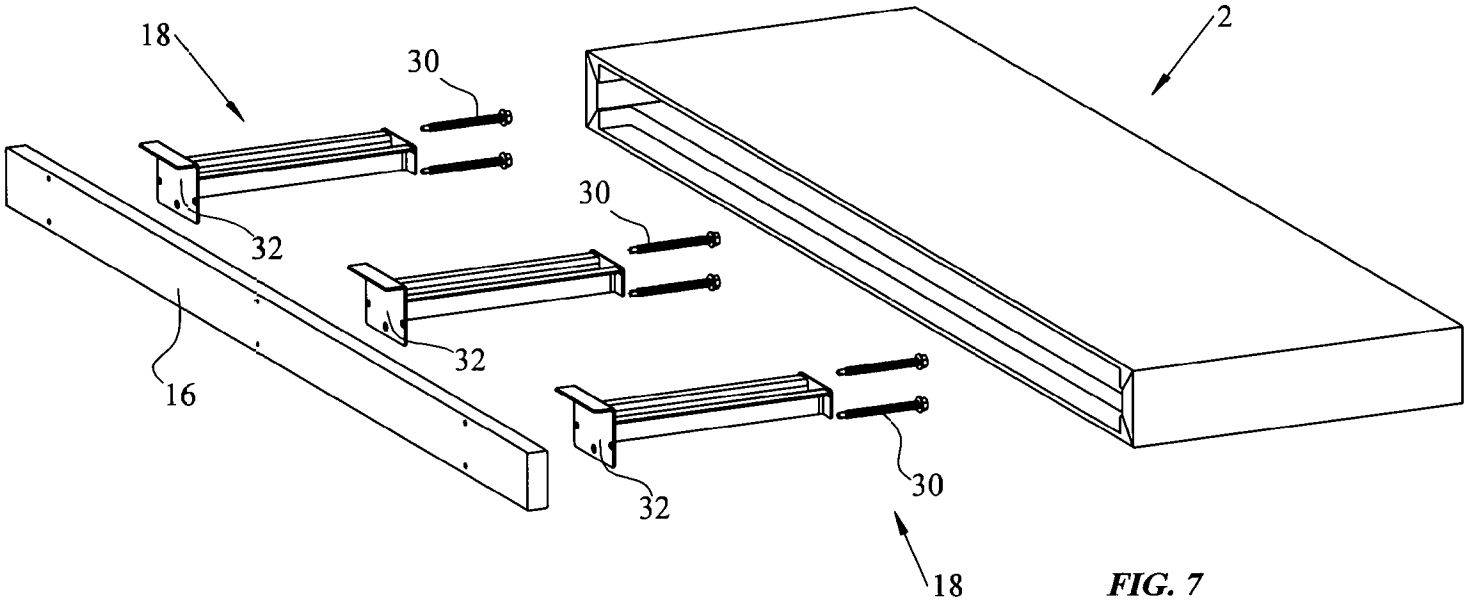
FIG. 7 illustrates a rear perspective view of shelving system of FIGS. 3 and 4 further including fasteners.

FIGS. 3 and 4 illustrate an embodiment of a shelving system comprising a shelf 2, a mount 16, and brackets 18. The bracket 18 includes a body 20 extending in a longitudinal direction from a first end 22 to a second end 24. The first ends 22 of the brackets 18 can be attached to a substrate, such as a wall, by the mount 16. The brackets also include tabs 28 extending at an angle orthogonal to the longitudinal direction of the body of the brackets. FIGS. 5 and 6 provide transparent views of a shelf unit comprising the shelf 2, mount 16, brackets 18 assembled from the shelving system illustrated in FIGS. 3 and 4. FIG. 7 illustrates the shelving system in FIGS. 3 and 4 further including fasteners 30 for fixing a shelf unit to a substrate, such as a wall. The fasteners 30 can pass through plates 32 provided at the first ends 22 of the brackets, through the mount 16, and into a substrate, such as a wall.

Figure 8:
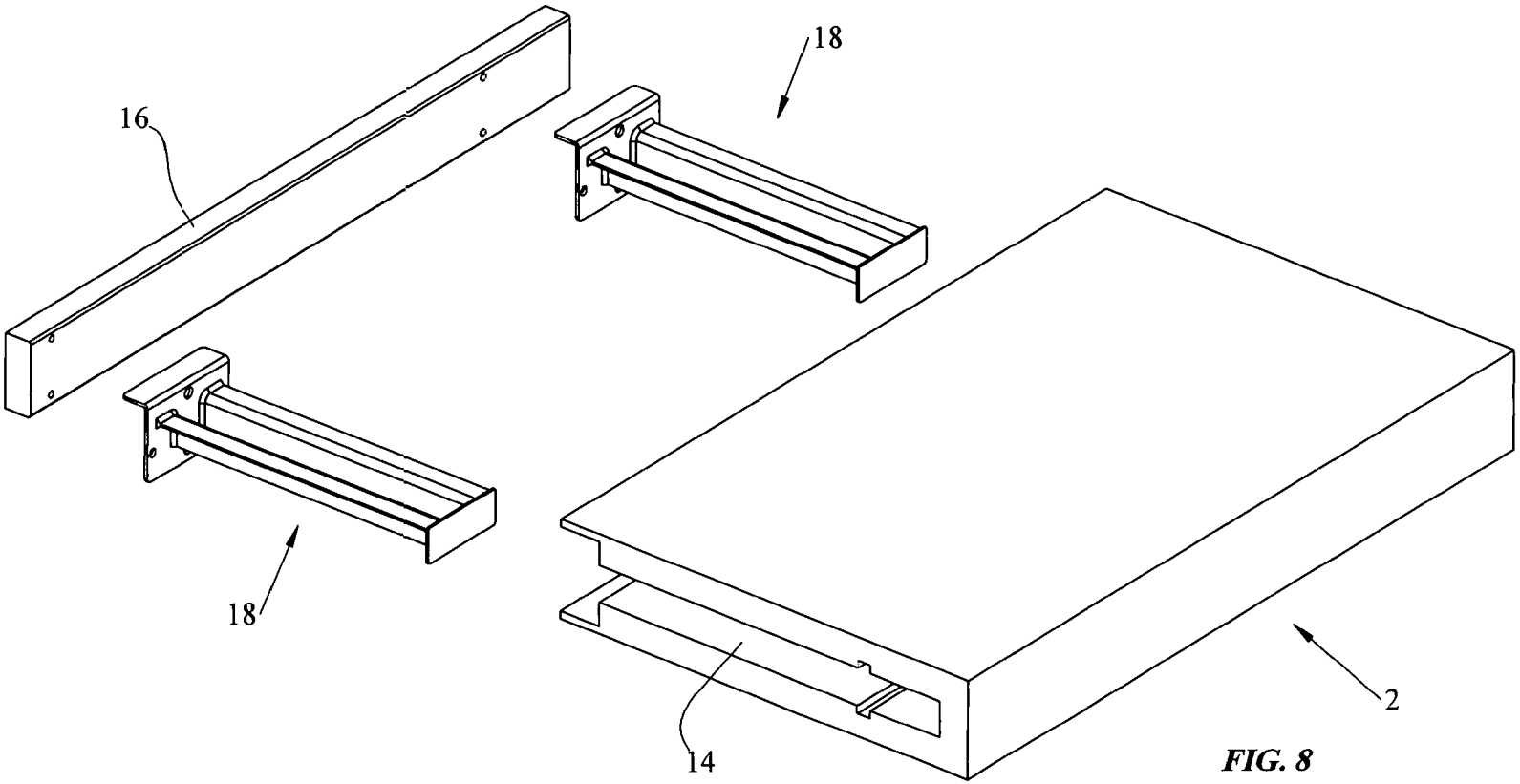
FIG. 8 illustrates a front perspective cross-sectional view of the shelving system of FIGS. 3 and 7.
Figure 9:
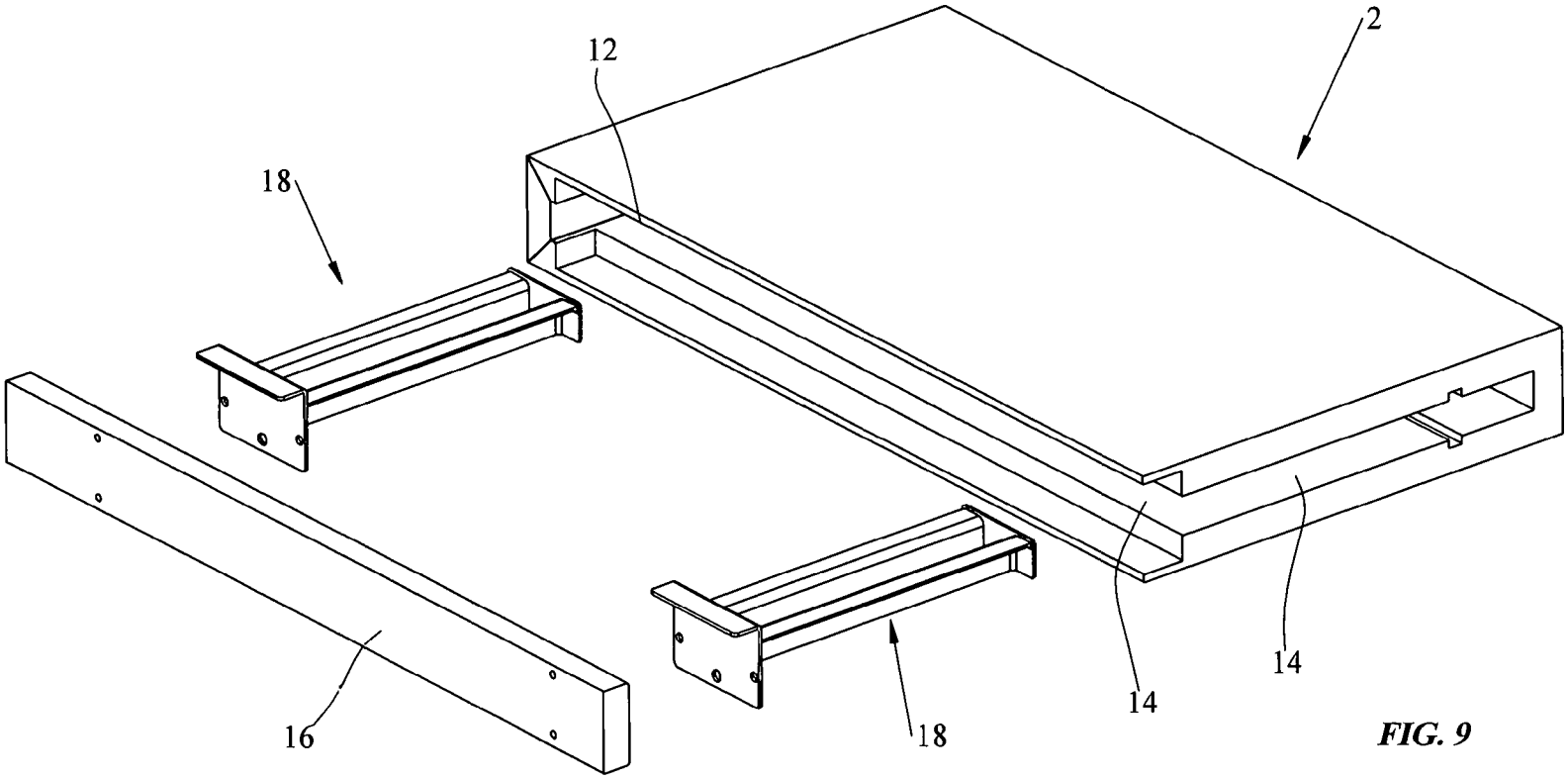
FIG. 9 illustrates a rear perspective cross-sectional view of the shelving system of FIG. 8.
Figure 10:
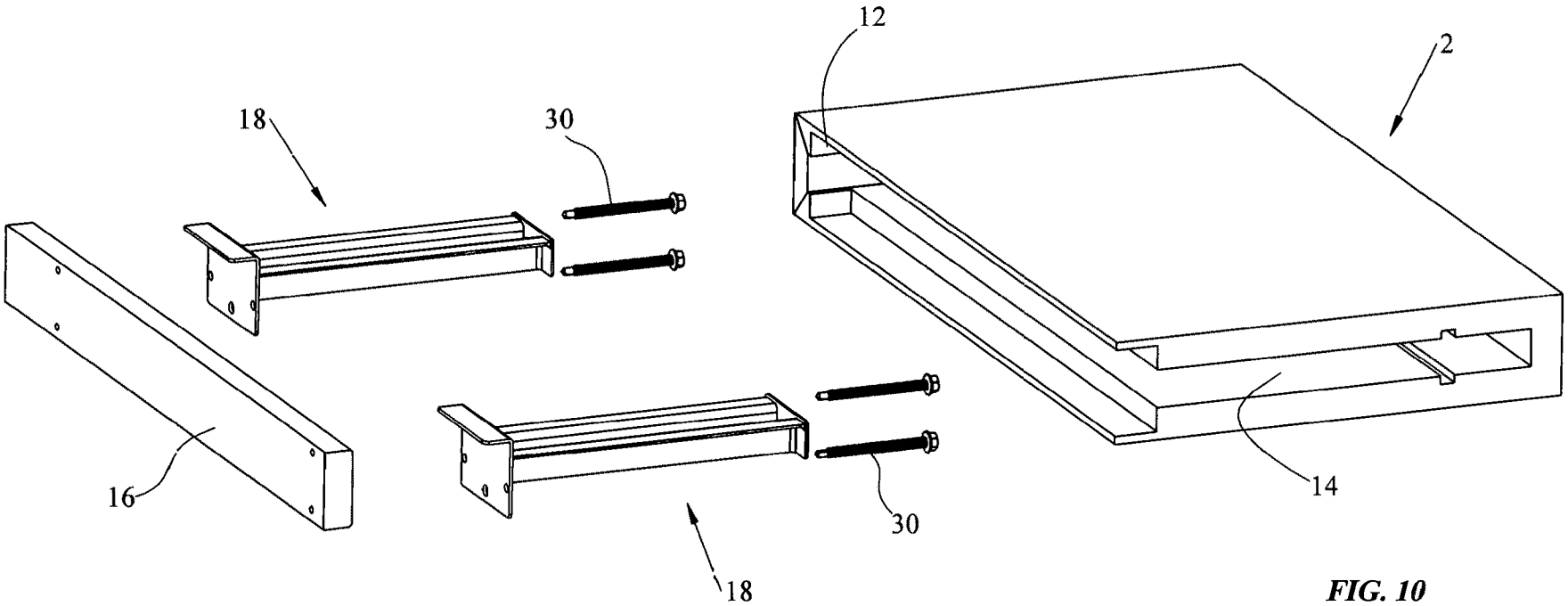
FIG. 10 illustrates a rear perspective cross-sectional view of shelving system of FIGS. 8 and 9 further including fasteners.
Figure 11:
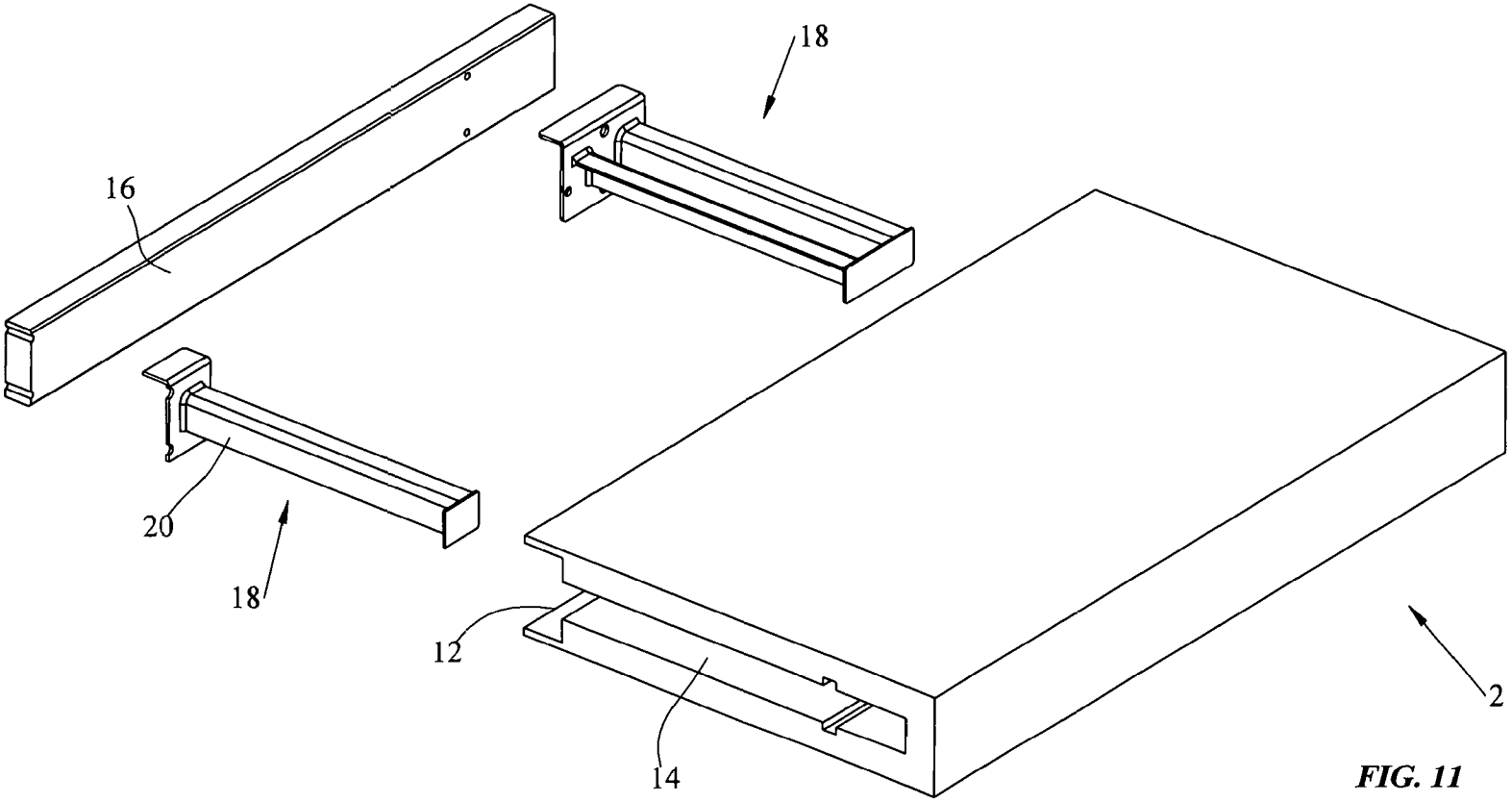
FIG. 11 illustrates a front perspective cross-sectional view of the shelving system of FIGS. 3, and 4.
Figure 12:
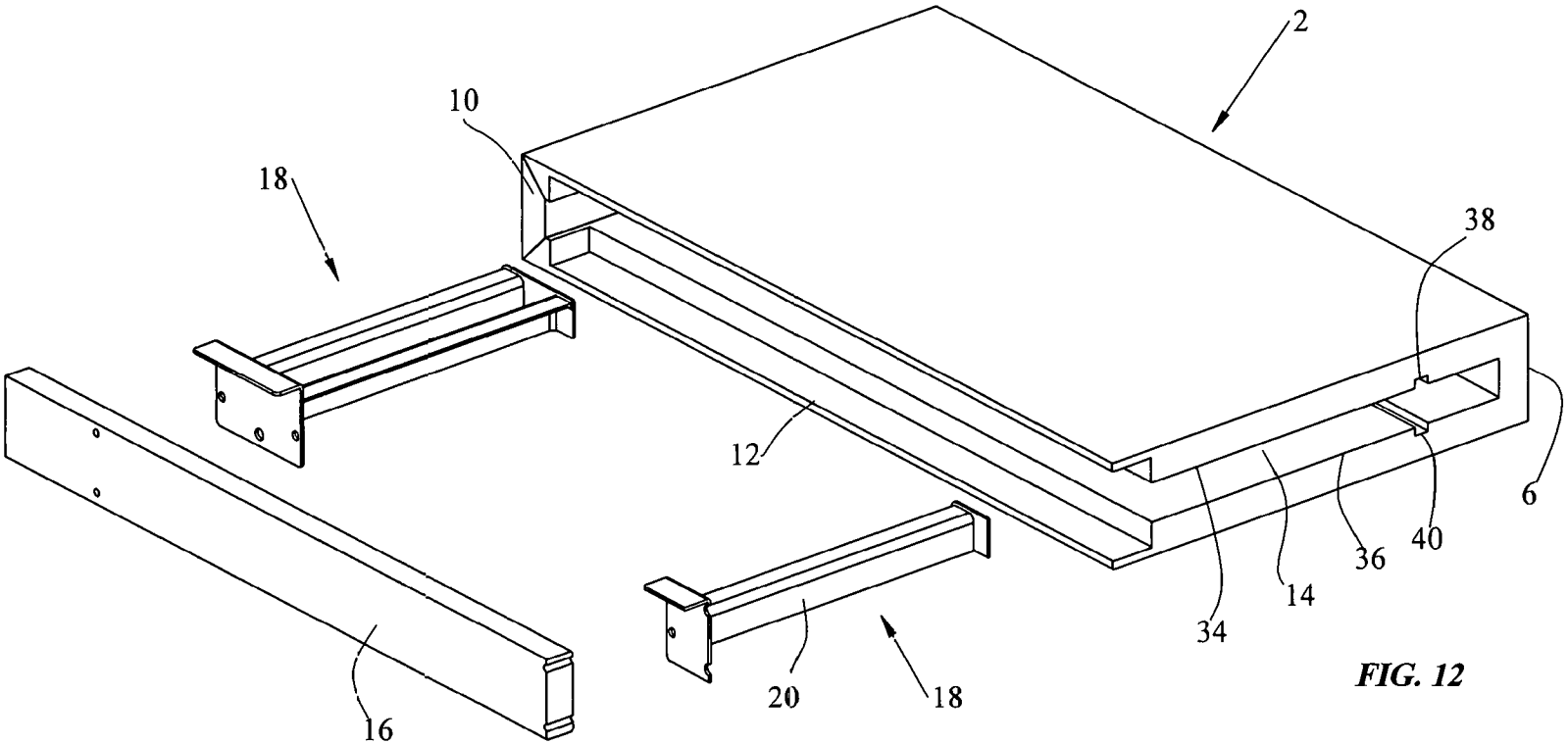
FIG. 12 illustrates a rear perspective cross-sectional view of the shelving system of FIG. 11.

FIGS. 8-10 illustrate cross-sectional views of the embodiment of the shelving system illustrated in FIGS. 3, and 4, taken at a position adjacent and parallel to the longitudinal direction of one of the brackets 18. The shelf 2 includes an opening 12 to a cavity 14. FIGS. 11 and 12 illustrate additional cross-sectional views of the shelving system illustrated in FIGS. 3 and 4, taken position along a longitudinal axis of the body 20 of the bracket 18. The cavity 14 of the shelf 2 includes an upper surface 34 and a lower surface 36. The upper surface comprises an upper groove 38 and the lower surface comprises a lower groove 40. The upper and lower groves are spaced the same distance from the opening 12 of the cavity. The depth of the cavity extends substantially the entire depth of the shelf 2, from the front surface 6 to the rear surface 10, without extending through the front surface 6. When a bracket 18 is inserted into the cavity 14, the tab 28 at the second end of the bracket extends to a position corresponding to the grooves. When the shelf 2 rests by the force of gravity upon the bracket 18 attached to a substrate, such as a wall, the upper surface 34 of the of the cavity 14 rests on the body 20 of the bracket 18, and the tab 28 engages the upper groove 38.

Figure 13:
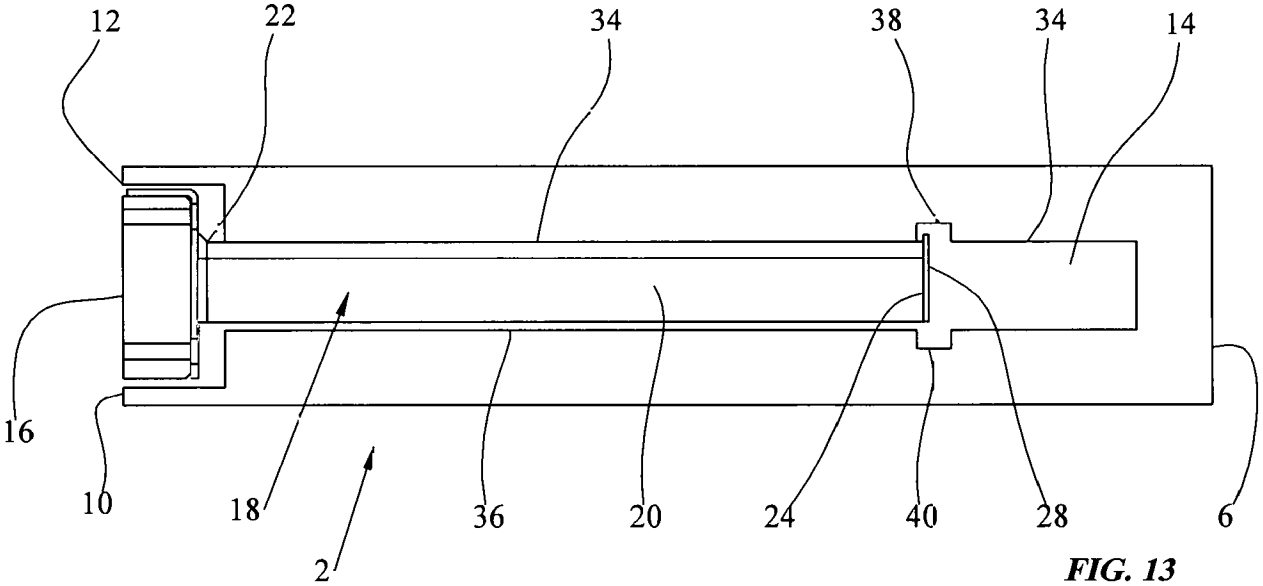
FIG. 13 illustrates side elevation cross-sectional view of shelf unit assembled from the shelving system of FIGS. 11 and 12.

FIG. 13 illustrates a side cross-sectional view of a shelf unit assembled from the shelving system illustrated in FIGS. 3 and 4. The shelf unit includes the bracket 18 inserted in the cavity 14 of the shelf 2. The upper surface 34 of the cavity 14 rests on the bracket 18 by the force of gravity and the tab 28 disposed at the second end 24 of the bracket 18 engages the upper groove 38 and prevents the shelf from sliding off the bracket unless the shelf is lifted. The depth of the cavity 14 is sufficient to receive the mount 16, the bracket 18, and the tab 28. A height of the cavity 14 is greater than a height of the bracket 18 including the tab 28 so as to allow the bracket to be easily and fully inserted in the cavity and hidden within the shelf. A height of the cavity 14 can be measured in a direction from the bottom surface 44 toward the top surface 4 of the shelf. A height of the bracket can be measured in a direction perpendicular to both the longitudinal direction and a width direction of the bracket. The longitudinal direction of the bracket 18 extends from the first end 22 to the second end 24 of the body 20. A width direction of a bracket can be from one side surface of a shelf 2 to an opposite side surface of the shelf when the bracket is inserted in the cavity 14.

Figure 14:
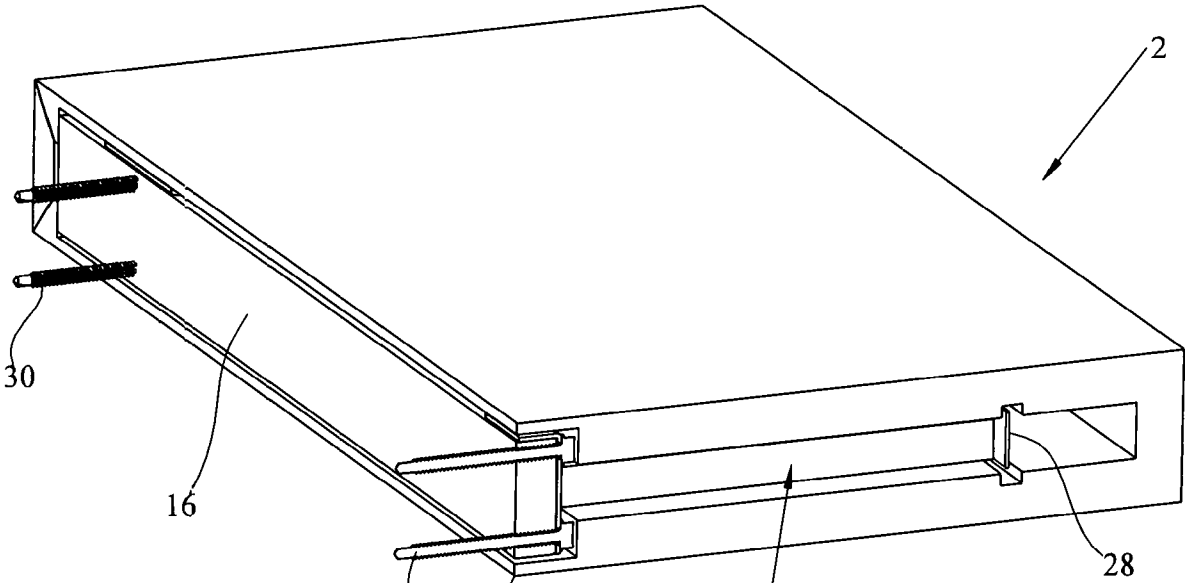
FIG. 14 illustrates a rear perspective cross-sectional view of an embodiment of a shelf unit including fasteners.
Figure 15:
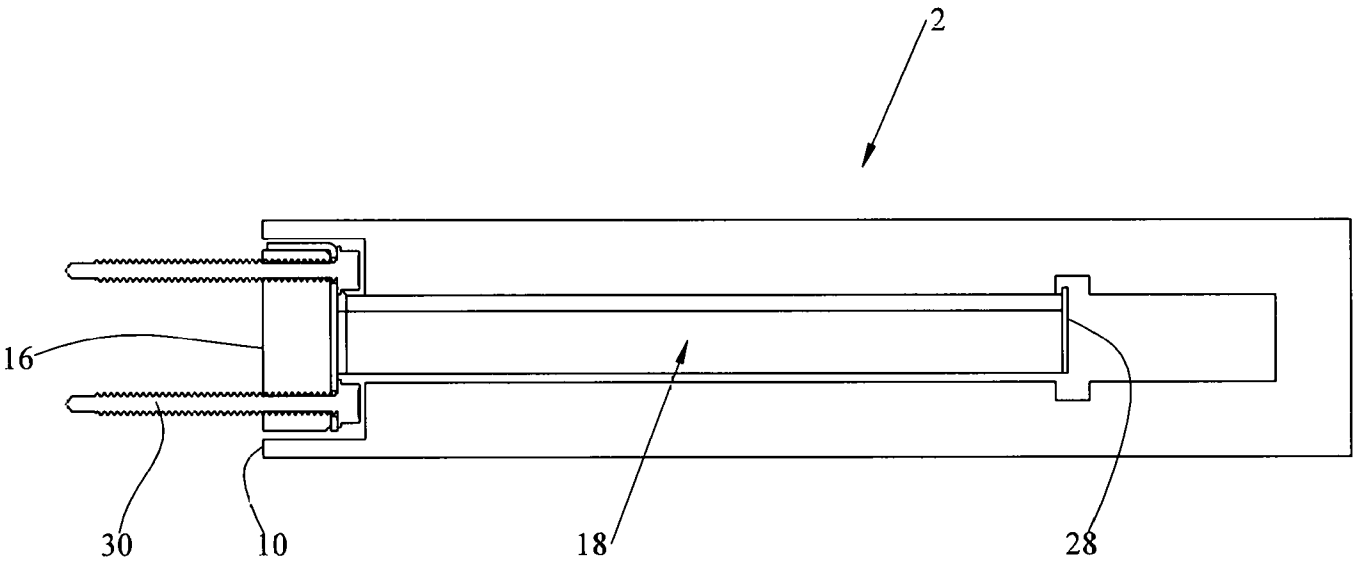
FIG. 15 illustrates side elevation cross-sectional view of the shelf unit of FIG. 14.

FIGS. 14 and 15 illustrate cross-sectional views of an embodiment of a shelf unit including a shelf 2, bracket 18, mount 16, and fasteners 30 for attaching the shelf unit to a substrate such as a wall. In both FIGS. 14 and 15, the depth of the cavity is at least half of a depth of the shelf 2 from the rear surface 10 to the front surface 6, and the depth of the cavity is sufficient to receive the mount 16, the bracket 18, and the tab 28, with the bracket extending through at least half the depth of the cavity.

Figure 16:
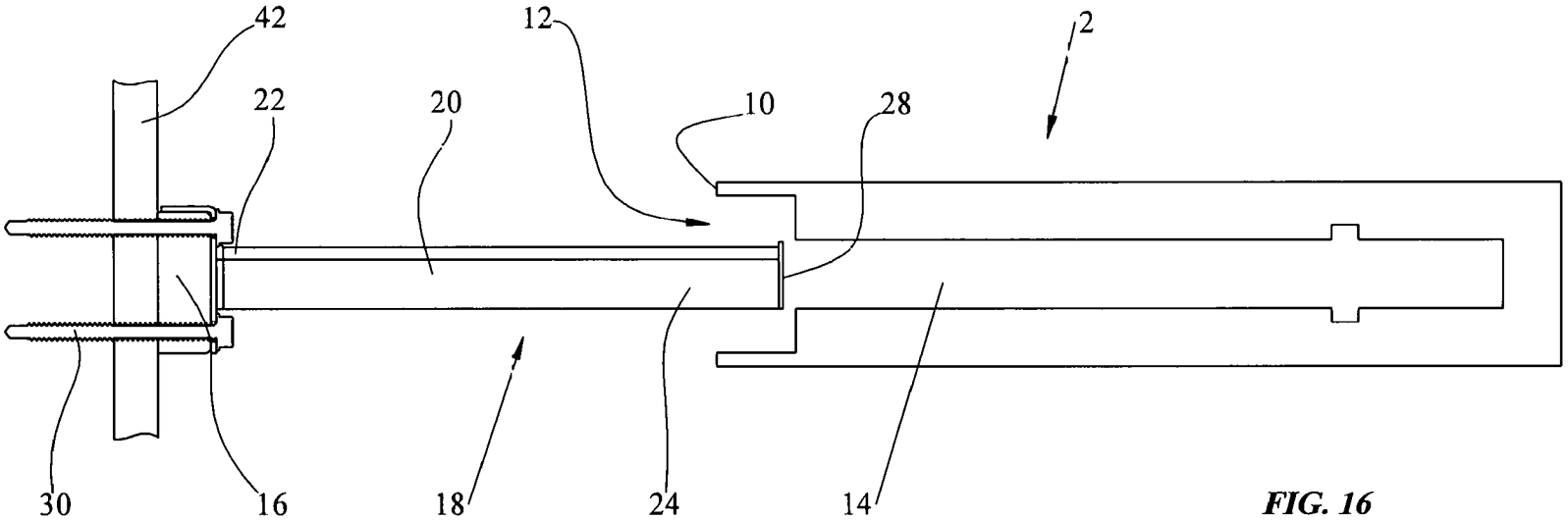
FIG. 16 illustrates a bracket fastened to a mount and a wall and a shelf being inserted onto the bracket.
Figure 17:
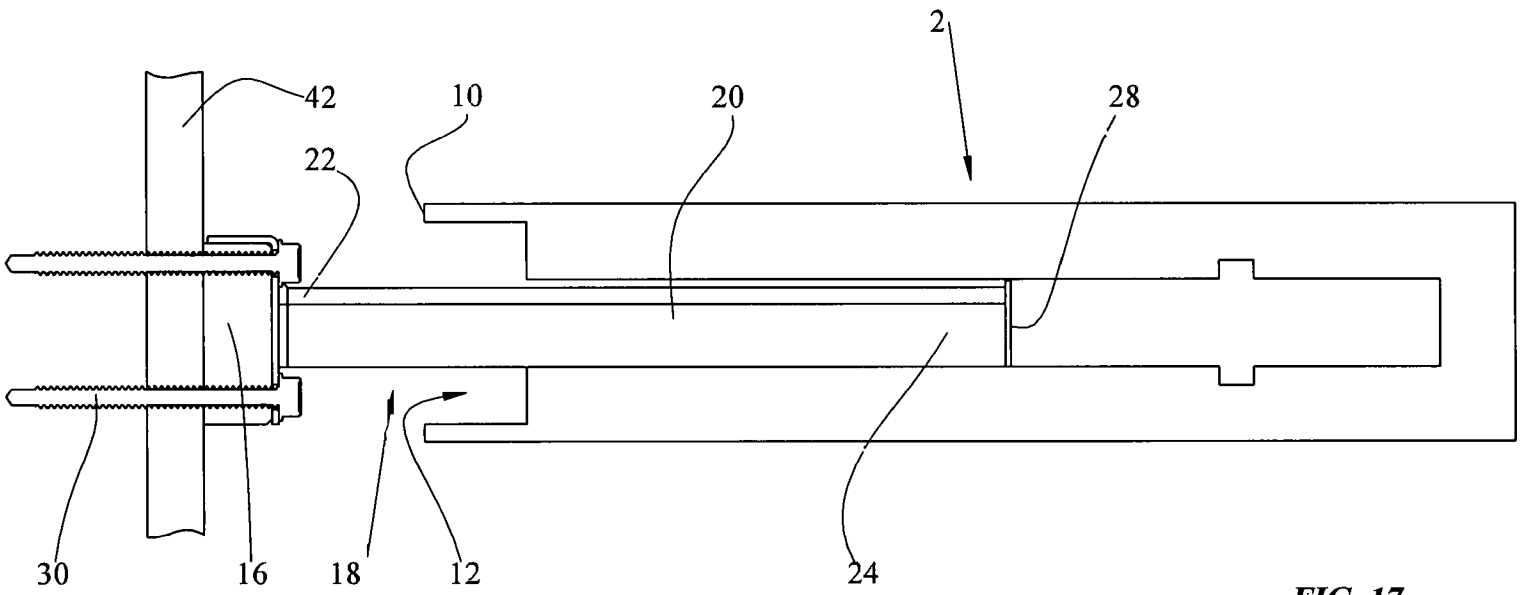
FIG. 17 illustrates the bracket and shelf of FIG. 16, with the bracket further inserted into the shelf.
Figure 18:
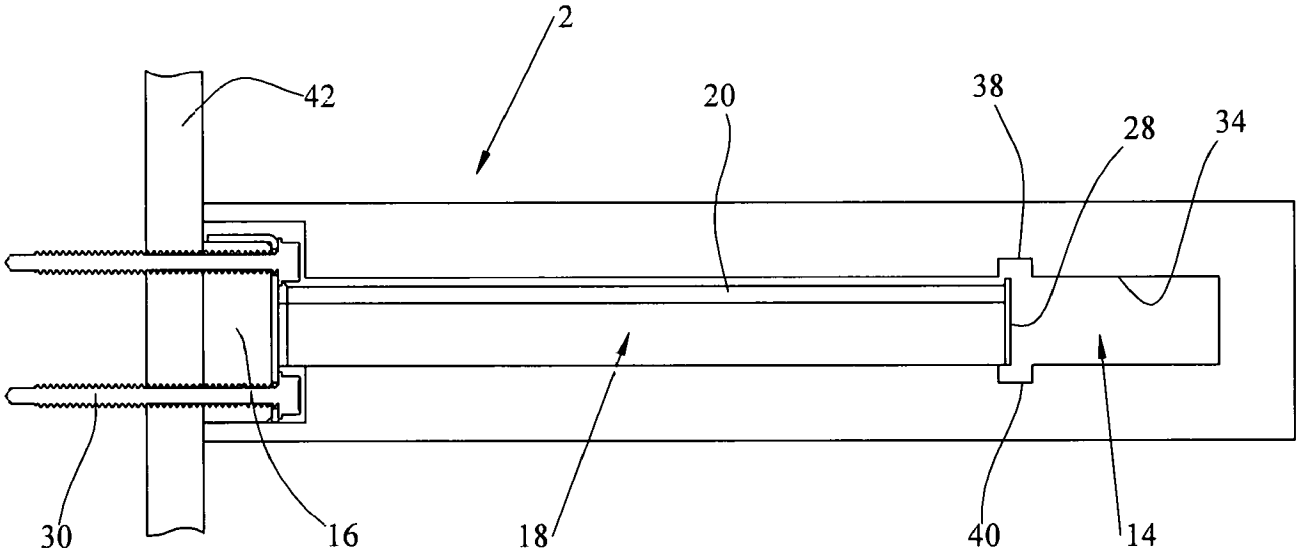
Figure 19:
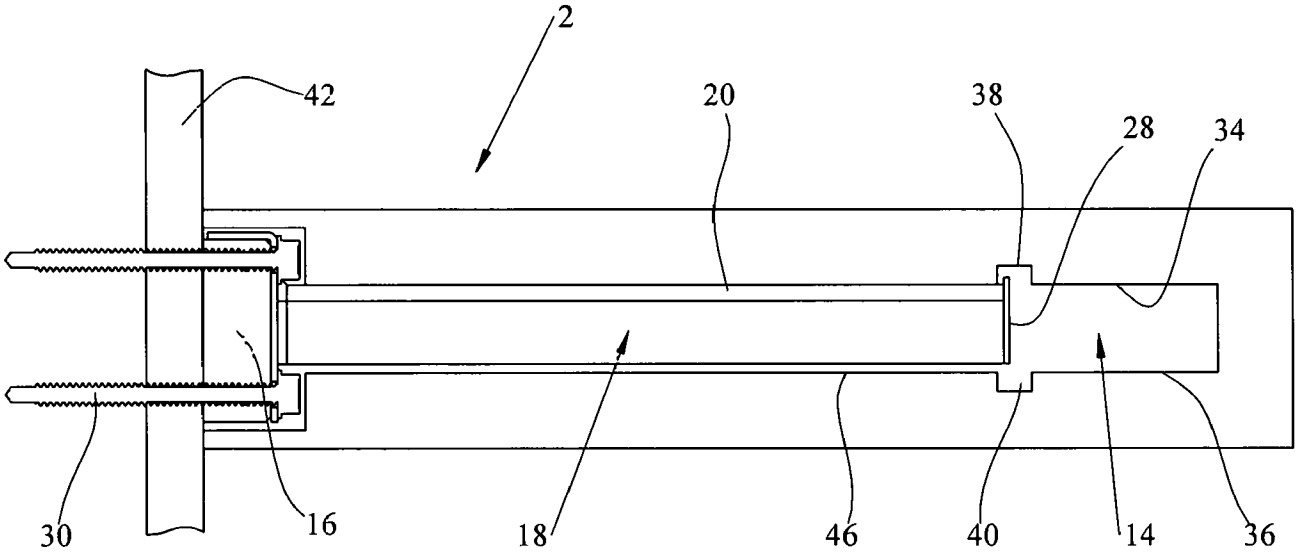
FIG. 19 illustrates the bracket and shelf of FIGS. 16 and 17, with the bracket resting on the shelf.

FIGS. 16-19 illustrate an embodiment of a method of assembling a shelf unit. The method includes fastening a first end 22 of a bracket 18 to both a mount 16 and a substrate 42, e.g. wall, using fasteners 30. The bracket 18 includes a body 20 extending in a longitudinal direction from the first end 22 to a second end 24. A tab 28 is located at the second end 24 and extends at an angle orthogonal to the longitudinal direction of the body. As illustrated in FIGS. 16 and 17, the method also includes inserting the second end 24 of the bracket 18 into an opening 12 to a cavity 14 on a rear surface 10 of a shelf 2. As illustrated in FIG. 18, the bracket 18 is pushed into the cavity until the cavity fully receives the bracket and mount 16. FIG. 19 illustrates engaging the tab 28 with a groove 38 formed in an upper surface 44 of the cavity 14 and allowing the upper surface 34 of the cavity 14 to rest on the body 20 of the bracket 18. A clearance 46 between the lower surface of the bracket and the lower surface of the cavity 36 allows the shelf to be lifted so that the upper surface 34 of the cavity disengages the body 20 of the bracket and the tab 28 disengages the upper groove 38. The shelf can then be withdrawn form the bracket. The shelf can also be flipped over in fed onto the bracket so that the lower groove 10 can engage the tab 28.

In a first aspect, a shelving system can comprise:

at least one bracket comprising a body extending in a longitudinal direction from a first end for attachment to a wall to a second end, and a locking member extending from the body at an angle to the longitudinal direction; and a shelf including a top surface, a bottom surface, a rear surface, and a front surface, the rear surface including an opening to a cavity, a height of the cavity measured in a direction from the bottom surface toward the top surface of the shelf being greater than a height of the bracket, the cavity including an upper surface comprising an upper groove, and the locking member to engage the upper groove as the upper surface of the cavity rests on the body of the bracket.

In the above first aspect, a depth of the cavity is sufficient to receive the bracket and the locking member.

In each of the above regarding the first aspect, the locking member is disposed at the second end of the bracket.

In each of the above regarding the first aspect, the shelving system further comprises a mount, the first end of the bracket being for attachment to the mount, and the mount being for attachment to the wall; and a depth of the cavity being sufficient to receive the mount, the bracket, and the locking member.

In each of the above regarding the first aspect, the shelving system comprises more than one of the bracket.

In each of the above regarding the first aspect, the locking member comprises a tab extending at an angle orthogonal to the longitudinal direction of the body, and the tab to engage the upper groove as the upper surface of the cavity rests on the body of the bracket.

In each of the above regarding the first aspect, the cavity further includes a lower surface comprising a lower groove, the upper and lower grooves being spaced the same distance from the opening.

In each of the above regarding the first aspect, a depth of the cavity is least half of a depth of the shelf from the rear surface to the front surface, the depth of the cavity is sufficient to receive the bracket and the locking member with the bracket extending through at least half the depth of the cavity.

In a second aspect, a shelf unit can comprise:

at least one bracket comprising a body extending in a longitudinal direction from a first end attached to a wall to a second end, and a locking member extending from the body at an angle to the longitudinal direction; and a shelf including a top surface, a bottom surface, a rear surface, and a front surface, the rear surface including an opening to a cavity, a height of the cavity measured in a direction from the bottom surface toward the top surface of the shelf being greater than a height of the bracket, the cavity including an upper surface comprising an upper groove, the upper surface of the cavity resting on the body of the bracket, and the locking member engaging the upper groove.

In the above second aspect, a depth of the cavity receives the bracket and the locking member.

In each of the above regarding the second aspect, the locking member is disposed at the second end of the bracket.

In each of the above regarding the second aspect, the shelving unit further comprises a mount, the first end of the bracket being attached to the mount, and the mount being attached to the wall; and a depth of the cavity receives the mount, the bracket, and the locking member.

In each of the above regarding the second aspect, the shelf unit comprises more than one of the bracket.

In each of the above regarding the second aspect, the locking member comprises a tab extending at an angle orthogonal to the longitudinal direction of the body, the upper surface of the cavity rests on the body of the bracket, and the tab is in engagement with the upper groove.

In each of the above regarding the second aspect, the cavity further includes a lower surface comprising a lower groove, the upper and lower grooves being spaced the same distance from the opening.

In each of the above regarding the second aspect, a depth of the cavity is at least half of a depth of the shelf from the rear surface to the front surface, the depth of the cavity receives the bracket and the locking member with the bracket extending through at least half the depth of the cavity, In a third aspect, a method of assembling a shelf unit can comprise:

fastening at least one bracket to a wall, the bracket comprising a body extending in a longitudinal direction from a first end to a second end, the first end being fastened to the wall, and a locking member extending from the body at an angle to the longitudinal direction;

inserting the second end of the bracket into an opening to a cavity on a rear surface of a shelf;

engaging the locking member with a groove formed in an upper surface of the cavity; and allowing the upper surface of the cavity to rest on the body of the bracket.

In the above third aspect, the method further comprises fastening a mount to a wall and fastening the first end of the bracket to the mount.

In each of the above regarding the third aspect, the locking member is disposed at the second end of the bracket.

In each of the above regarding the third aspect, the locking member comprises a tab extending at an angle orthogonal to the longitudinal direction of the body, and the tab engaging the groove.

All methods described herein can be performed in any suitable order unless otherwise indicated herein or otherwise clearly contradicted by context. The use of any and all examples, or language describing an example (e.g., "such as") or embodiment provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the claims. Neither the marking of the patent number on any product nor the identification of the patent number in connection with any service should be deemed a representation that all embodiments described herein are incorporated into such product or service.

What is claimed is:

1. A shelving system comprising:

at least one bracket comprising a body extending in a longitudinal direction from a first end for attachment to a wall to a second end, and a locking member extending from the body at an angle to the longitudinal direction; and a shelf including a top surface, a bottom surface, a rear surface, and a front surface, the rear surface including an opening to a cavity, a height of the cavity measured in a direction from the bottom surface toward the top surface of the shelf being greater than a height of the bracket, a depth of the cavity being at least half of a depth of the shelf from the rear surface to the front surface, the depth of the cavity being sufficient to receive the bracket and the locking member with the bracket extending through at least half the depth of the cavity, the cavity including a lower surface and an upper surface the upper surface of the cavity comprising an upper slot, and the locking member fitting within the upper slot when the upper surface of the cavity rests on the body of the bracket.

2. The shelving system of claim 1, the locking member being disposed at the second end of the bracket.

3. The shelving system of claim 1 further comprising a mount, the first end of the bracket being for attachment to the mount, and the mount being for attachment to the wall.

4. The shelving system of claim 3, a depth of the cavity being sufficient to receive the mount, the bracket, and the locking member.

5. The shelving system of claim 1 comprising more than one of the bracket.

6. The shelving system of claim 2, the locking member comprising a tab extending at an angle orthogonal to the longitudinal direction of the body, and the tab fitting within the upper slot when the upper surface of the cavity rests on the body of the bracket.

7. The shelving system of claim 1, the lower surface of the cavity comprising a lower slot, the upper and lower slots being spaced the same distance from the opening.

8. A shelf unit comprising:

at least one bracket comprising a body extending in a longitudinal direction from a first end attached to a wall to a second end, and a locking member extending from the body at an angle to the longitudinal direction; and a shelf including a top surface, a bottom surface, a rear surface, and a front surface, the rear surface including an opening to a cavity, a height of the cavity measured in a direction from the bottom surface toward the top surface of the shelf being greater than a height of the bracket, a depth of the cavity being at least half of a depth of the shelf from the rear surface to the front surface, the depth of the cavity receiving the bracket and the locking member with the bracket extending through at least half the depth of the cavity, the cavity including a lower surface and an upper surface, the upper surface of the cavity comprising an upper slot, the upper surface of the cavity resting on the body of the bracket, and the locking member being disposed within the upper slot.

9. The shelf unit of claim 8, the locking member being disposed at the second end of the bracket.

10. The shelf unit of claim 8 further comprising a mount, the first end of the bracket being attached to the mount, and the mount being attached to the wall.

11. The shelf unit of claim 10, a depth of the cavity receiving the mount, the bracket, and the locking member.

12. The shelf unit of claim 8 comprising more than one of the bracket.

13. The shelf unit of claim 9, the locking member comprising a tab extending at an angle orthogonal to the longitudinal direction of the body, the upper surface of the cavity resting on the body of the bracket, and the tab being disposed within the upper slot.

14. The shelf unit of claim 8, the lower surface of the cavity comprising a lower slot, the upper and lower slots being spaced the same distance from the opening.

15. A method of assembling a shelf unit, the method comprising:

fastening at least one bracket to a wall, the bracket comprising a body extending in a longitudinal direction from a first end to a second end, the first end being fastened to the wall, and a locking member extending from the body at an angle to the longitudinal direction;

inserting the second end of the bracket into an opening to a cavity on a rear surface of a shelf, the cavity including a lower surface and an upper surface, a depth of the cavity being at least half of a depth of the shelf from the rear surface to a front surface of the shelf, the depth of the cavity being sufficient to receive the bracket and the locking member with the bracket extending through at least half the depth of the cavity;

disposing the locking member in a slot formed in an upper surface of the cavity; and allowing the upper surface of the cavity to rest on the body of the bracket.

16. The method of claim 15, the fastening at least one bracket to a wall further comprising fastening a mount to a wall and fastening the first end of the bracket to the mount.

17. The method of claim 7, the locking member being disposed at the second end of the bracket.

18. The method of claim 17, the locking member comprising a tab extending at an angle orthogonal to the longitudinal direction of the body, and the tab being disposed in the slot.

19. The shelving system of claim 1, the locking member directly engaging the upper slot.

20. The shelving system of claim 1, the shelving system being configured to be assembled by feeding the at least one bracket along the longitudinal direction of the body into the opening of the cavity on the rear surface of the shelf.

21. The shelving system of claim 1, a height of the opening to the cavity on the rear surface of the shelf, measured in a direction from the bottom surface toward the top surface of the shelf, is greater than a height of the bracket.

* * * * *